US007661529B2

(12) United States Patent
Anderson et al.

(10) Patent No.: US 7,661,529 B2
(45) Date of Patent: Feb. 16, 2010

(54) STACKABLE STORAGE TRAYS

(75) Inventors: Scott L. Anderson, Canton, OH (US); Daniel J. Long, North Canton, OH (US); John J. Wojcicki, Jr., Bolivar, OH (US)

(73) Assignee: Everhard Products, Inc., Canton, OH (US)

( * ) Notice: Subject to any disclaimer, the term of this patent is extended or adjusted under 35 U.S.C. 154(b) by 437 days.

(21) Appl. No.: 11/810,596

(22) Filed: Jun. 5, 2007

(65) Prior Publication Data

US 2007/0241020 A1 Oct. 18, 2007

Related U.S. Application Data

(63) Continuation-in-part of application No. 10/789,335, filed on Feb. 27, 2004, now abandoned.

(51) Int. Cl.
*B65D 21/032* (2006.01)

(52) U.S. Cl. ..... 206/510

(58) Field of Classification Search ..... 220/507, 220/770, 752; 206/510, 511
See application file for complete search history.

(56) References Cited

U.S. PATENT DOCUMENTS 654,492 A * 7/1900 Ross ..... 220/770
2,339,168 A * 1/1944 Hutchings ..... 206/164
2,777,597 A * 1/1957 Ruff ..... 206/509
3,587,915 A 6/1971 Theobald
4,204,596 A 5/1980 Davis
5,415,277 A 5/1995 Berntsen
D511,894 S 11/2005 Janney, Jr. et al.
2003/0234895 A1 12/2003 Sugawara et al.

* cited by examiner

*Primary Examiner*—Stephen Castellano
(74) *Attorney, Agent, or Firm*—Sand & Sebolt

(57) ABSTRACT

An improved stackable storage tray has a flat bottom wall with a generally U-shaped recess formed therein, a pair of end walls with a bar extending therebetween for manually transporting the tray, a pair of outwardly sloped side walls, and a plurality of dividers extending between the side walls and upwardly extending divider walls forming a plurality of sub-compartments. The improvements include a pair of spaced generally right angled ledges on the end walls which lie in a horizontal plane with top edges of the side wall, sub-compartment dividers, and a divider edge formed by the upstanding divider walls for supporting an upper tray stacked thereon; a plurality of bosses on the bottom wall providing support feet for the tray; and drain holes in the bosses and in the sub-compartments dividers for removing any liquid trapped in the sub-compartments.

20 Claims, 10 Drawing Sheets

STACKABLE STORAGE TRAYS

CROSS REFERENCE TO RELATED APPLICATIONS

This application is a Continuation-In-Part of U.S. patent application Ser. No. 10/789,335, filed Feb. 27, 2004 now abandoned; the disclosure of which is incorporated herein by reference.

BACKGROUND OF THE INVENTION

1. Technical Field

The invention related to stackable storage trays, and in particular to an improved stackable storage tray having enhanced stackability and increased utilitarianism.

2. Background Information

Numerous types of stackable storage trays have been developed which provide a manually transportable tray having a plurality of storage compartments for containing various items such as bolts, screws, nails, component parts, etc. which can be stacked in a vertical nested relationship to reduce storage space when not in use. One such storage tray of which the present invention is an improvement thereon is formed of galvanized steel and has a recess formed in a bottom wall thereof for receiving a carrying handle of an adjacent tray when in a stacked position. This prior art storage tray has a pair of angled divider walls which extend upwardly from the bottom wall for forming the carrying handle receiving recess in the bottom wall and has a plurality of divider panels which extend between these divider walls and side walls of the container for forming a plurality of sub-compartments for the storage of various items. The recess in the bottom wall forms two generally flat planar bottom sections which are adapted to rest upon upwardly sloped ledges formed in the end walls of the lower adjacent tray, or on a horizontal divider edge formed by the recess forming walls and/or edges of the tray side walls when in a stacked relationship with an adjacent tray. Although this tray construction provides various surfaces for supporting an adjacent tray stacked on top thereof, it does not provide a consistently broad and level support surface to insure a stable assembly when a plurality of the storage trays are stacked one upon the other.

The present storage tray on which the present invention is an improvement has no means to drain water or other liquid which could collect within the storage compartments requiring emptying of the compartments prior to draining the water therefrom or increase the difficulty in providing a dry storage area for various components stored therein. Also, the broad planar surfaces of the bottom wall of the tray provide a large area which increases sliding friction when slidably moving the tray in a storage area, such as on a shelf or other support surface.

The subject invention provides a number of improvements to this prior art stackable storage tray, which enables a plurality of the trays to be stacked in a very stable vertical relationship with easy accessibility into all of the sub-compartments through open exposed tops of the sub-compartments even when in a stacked arrangement. In addition, the tray of the present invention has additional improved features which increases the usability and economy of production of the tray discussed further below.

BRIEF SUMMARY OF THE INVENTION

The present invention provides a stackable storage tray having a plurality of sub-compartments for storing of various items. The tray is formed of a rigid galvanized steel and has a plurality of supporting surfaces which lie in a general horizontal plane on which the bottom surface of a tray stacked thereon rests to enhance the stackability of the trays. The contents of the sub-compartments are easily accessible through exposed open tops even when in a stacked arrangement.

Another feature of the present invention is forming a plurality of bosses on the bottom wall of the tray which provide a plurality of spaced surfaces for supporting the tray on a support surface which facilitates movement of the tray along a support surface by reducing the sliding friction therebetween. In addition, the support feet may be formed with holes through which water will drain from the storage compartments, and which can receive fasteners, such as screws, bolts, etc. for securely mounting the tray on a support surface.

A further feature of the present invention is forming the tray whereby a divider edge which is formed by angled walls extending upwardly from the bottom of the tray providing a handle receiving recess in the bottom wall, lies in a common horizontal plane with top edges of divider panels which divide the tray into a plurality of sub-compartments. Likewise, a pair of planar ledges are formed in end walls of the tray and lie in the same horizontal plane together with the top edges of the tray side walls. These various surfaces which lie in this horizontal plane provide a plurality of level supporting surfaces for supporting an adjacent tray stacked thereon.

Still another feature of the invention is to form the tray side, bottom, and end walls and divider panels of 24 gage galvanized steel which provides increased rigidity for the tray, enabling the tray to be manually transported by a carrying handle extending between the end walls without excessive flexing, and which enables a plurality of the trays to be stacked one upon the other in a stable relationship without damage or deformation to the lower-most trays.

A further feature of the invention is providing a stackable tray which has a plurality of drain holes between the sub-compartments within the main storage compartment of the tray, and in which drain holes are formed in the bottom wall and at one or more of the four bottom corners at the junctions of the side walls, end walls and bottom wall of the tray to remove unwanted liquid which may collect in the sub-compartments.

Another aspect of the invention is an improved attachment of the ends of the handle with the end walls to provide a rigid, less expensive construction by eliminating attachment bolts and fasteners used in prior storage trays.

The foregoing advantages, construction, and operation of the present invention will become more readily apparent from the following description and accompanying drawings.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
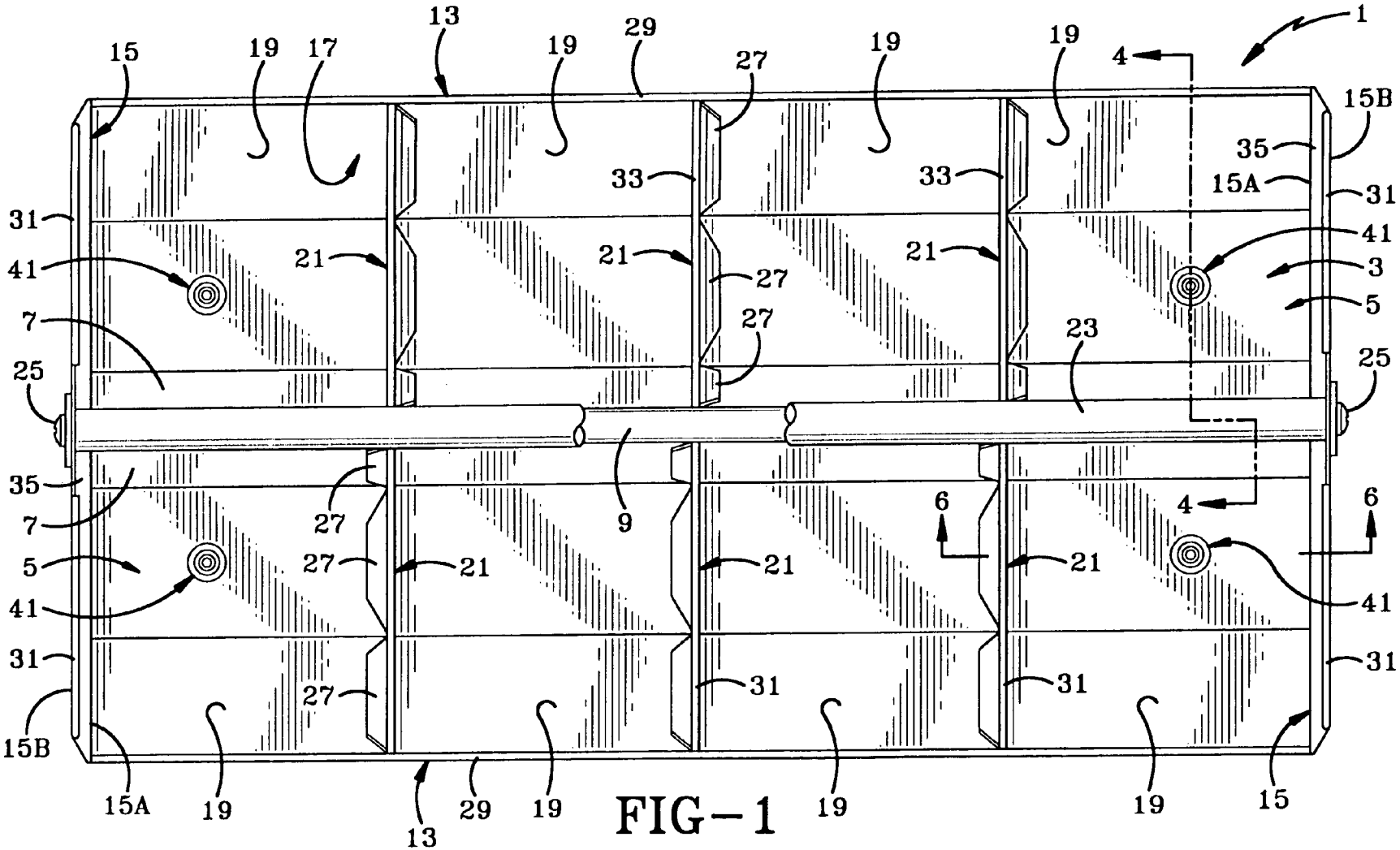
FIG. 1 is a top plan view of the stackable storage tray of the present invention.
Figure 2:
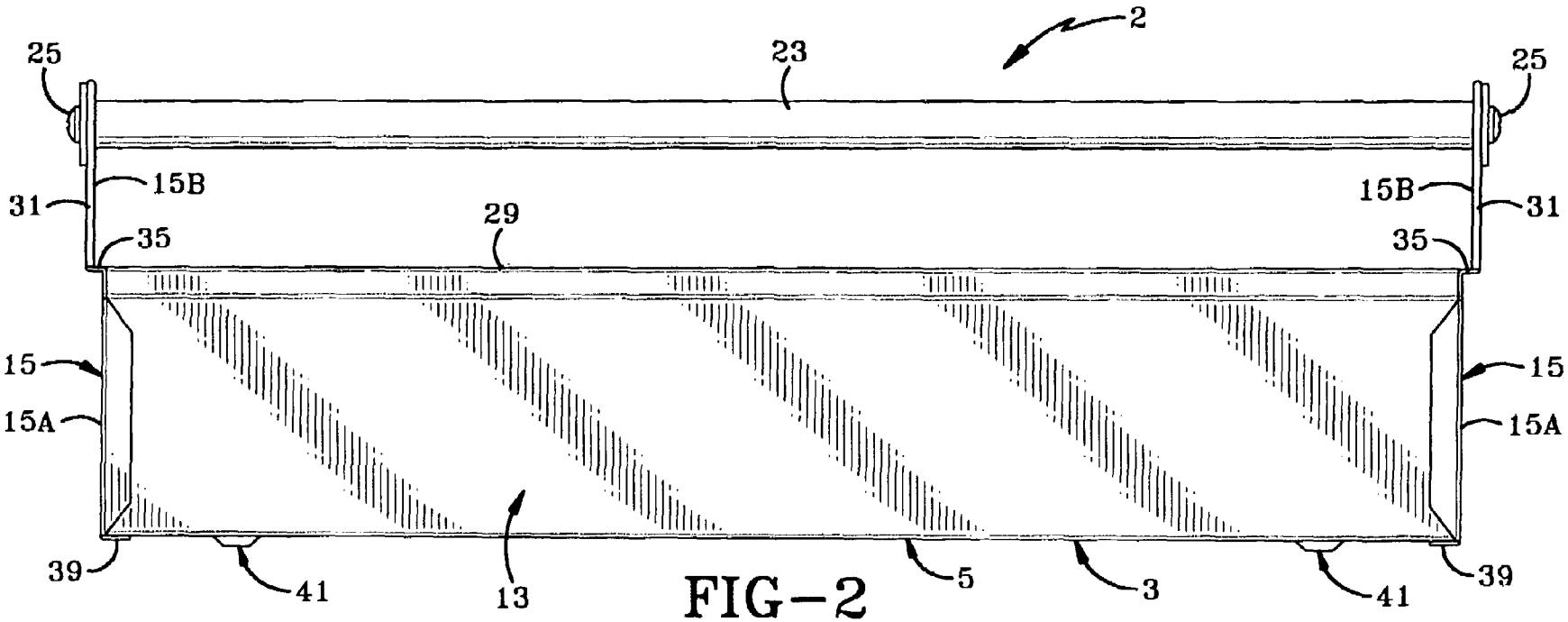
FIG. 2 is a side elevational view thereof.
Figure 3:
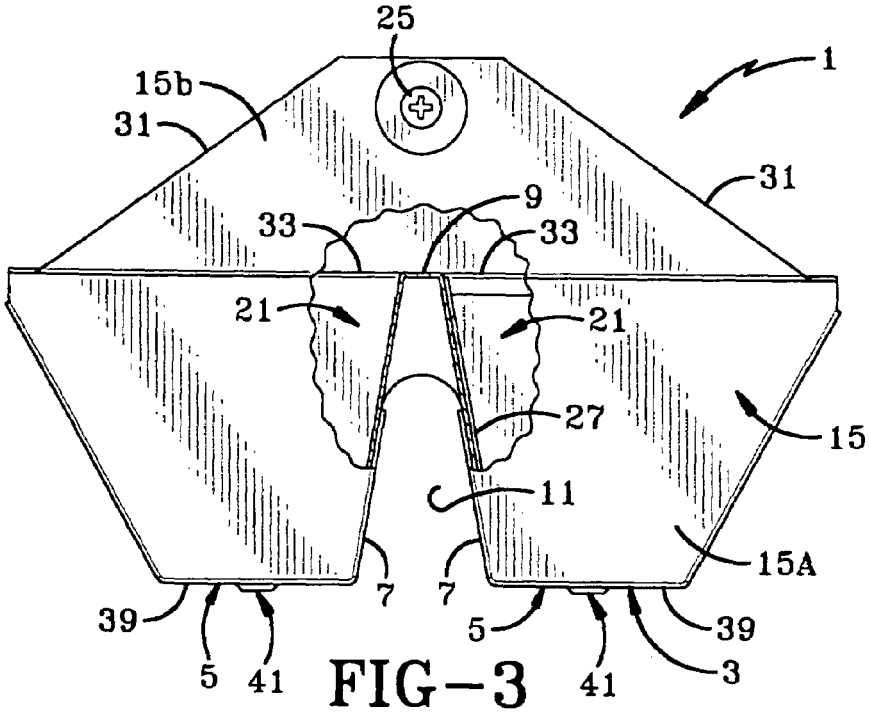
FIG. 3 is an end elevational view thereof, the opposite end being a mirror image thereof.

The improved stackable storage tray of the present invention is indicated generally at 1, and is shown particularly in FIGS. 1-3. Tray 1 includes a bottom wall indicated generally at 3, which includes a pair of generally planar sections 5 formed by a pair of angled upwardly extending divider walls 7. Walls 7 terminate in a flat divider edge 9 and form a U-shaped bottom wall recess 11 for receiving a carrying handle of an adjacent tray when stacked thereon as discussed below. Tray 1 further includes a pair of upwardly outwardly angled side walls 13 and a pair of spaced parallel end walls 15. Bottom wall 3, side walls 13 and end walls 15 form a main internal storage compartment 17 which is formed into a plurality of sub-compartments 19 by a plurality of divider panels 21, which extend between a selected one of the divider walls 7 and a side wall 13. Eight sub-compartments 19 are shown in the particular tray embodiment in the drawings, but could be various numbers without affecting the concept of the invention.

A carrying handle 23 extends between end walls 15 and can be connected thereto by fasteners 25 or other attachments means, such as welding or the like. Divider panels 21 are connected to bottom wall planar sections 5, angled divider walls 7, and side walls 13 by right angled flanges 27 which are secured thereto by rivets, spot welds, or other means of attachments. Likewise, top edges 29 of sidewall 13, top edges 31 of end walls 15, and top edges 33 of divider panels 21, are provided with reverse bent end flanges to provide strength and stiffening thereto, and to provide a smooth curved surface avoiding sharp dangerous edges.

The above description describes the stackable storage tray of which the present invention is an improvement thereon, with the improved features, construction, and arrangements being described further below.

Figure 6:
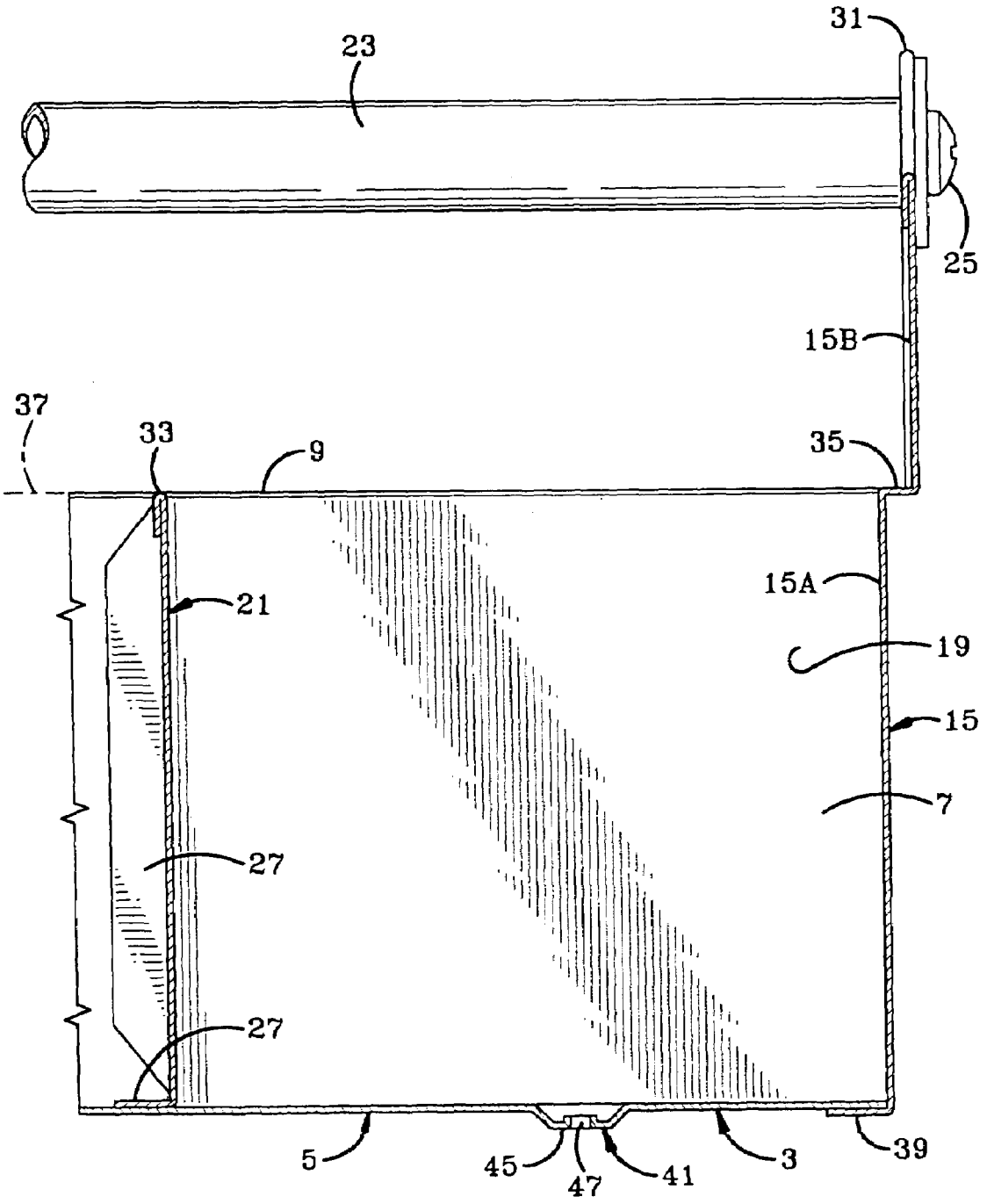
FIG. 6 is an enlarged fragmentary sectional view taken on line 6-6, FIG. 1.

In accordance with one of the main features of the invention, end walls 15 are provided with a lower portion 15A and an offset upper portion 15B (FIG. 6) defined by a generally flat planar ledge 35. Ledge 35 lies in a common horizontal plane 37 with top edges 29 of side walls 13, top edges 33 of divider panels 21, and with divider edge 9 formed by angled bottom walls 7. This provides a plurality of surfaces, all of which lie in a generally common horizontal plane, on which the bottom wall or in-turned bottom flanges 39 of end walls 15 of an adjacent tray will rest, when placed in a stacked relationship as shown particularly in FIGS. 7-10. Thus, this provides increased stability when a plurality of the trays are in a stacked position not provided by the prior art tray wherein the top edges of the divider panels are below the top edges of the side walls and divider edge, and the absence of the flat horizontal ledges of the off-set end walls, which in the prior art tray construction were angled.

As shown in FIG. 3, lower portion 15A of each wall 15 is formed within a U-shaped cutout which aligns with and is complementary to bottom wall recess 11.

When in a stacked relationship, one end of the upper tray will rest on one of the end wall ledges 35 with the other end and intervening bottom wall portions lying on top edges 33 of divider panels 21. Since they lie in the same horizontal plane, this insures that the upper tray is in a stable horizontal position. This is especially important where several trays are placed in a stacked relationship.

Figure 11:
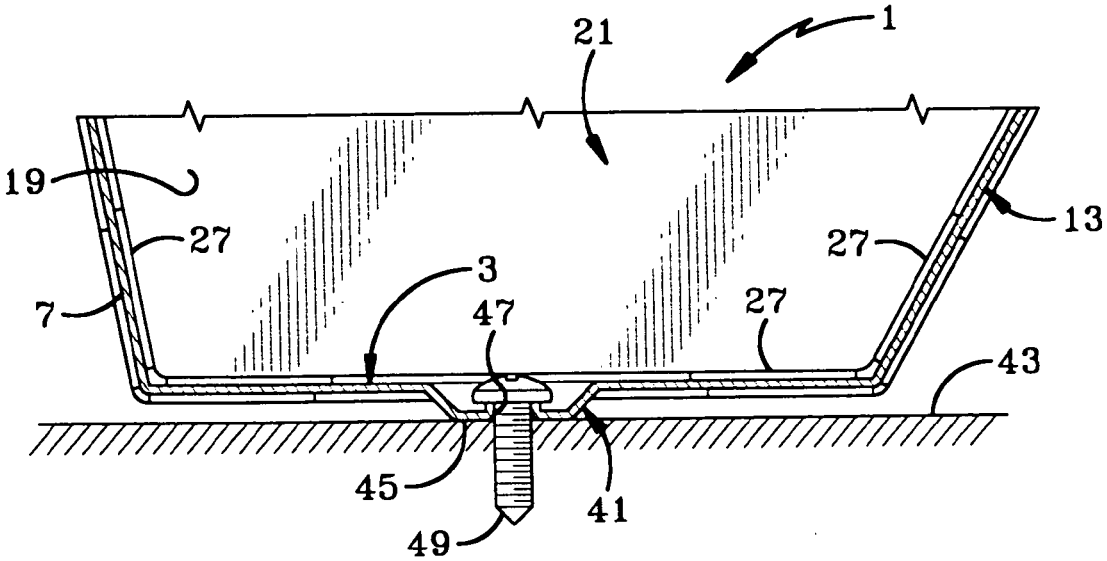
FIG. 11 is a fragmentary sectional view similar to FIG. 4 showing the tray being secured to a supporting surface by a fastening screw.
Figure 12:
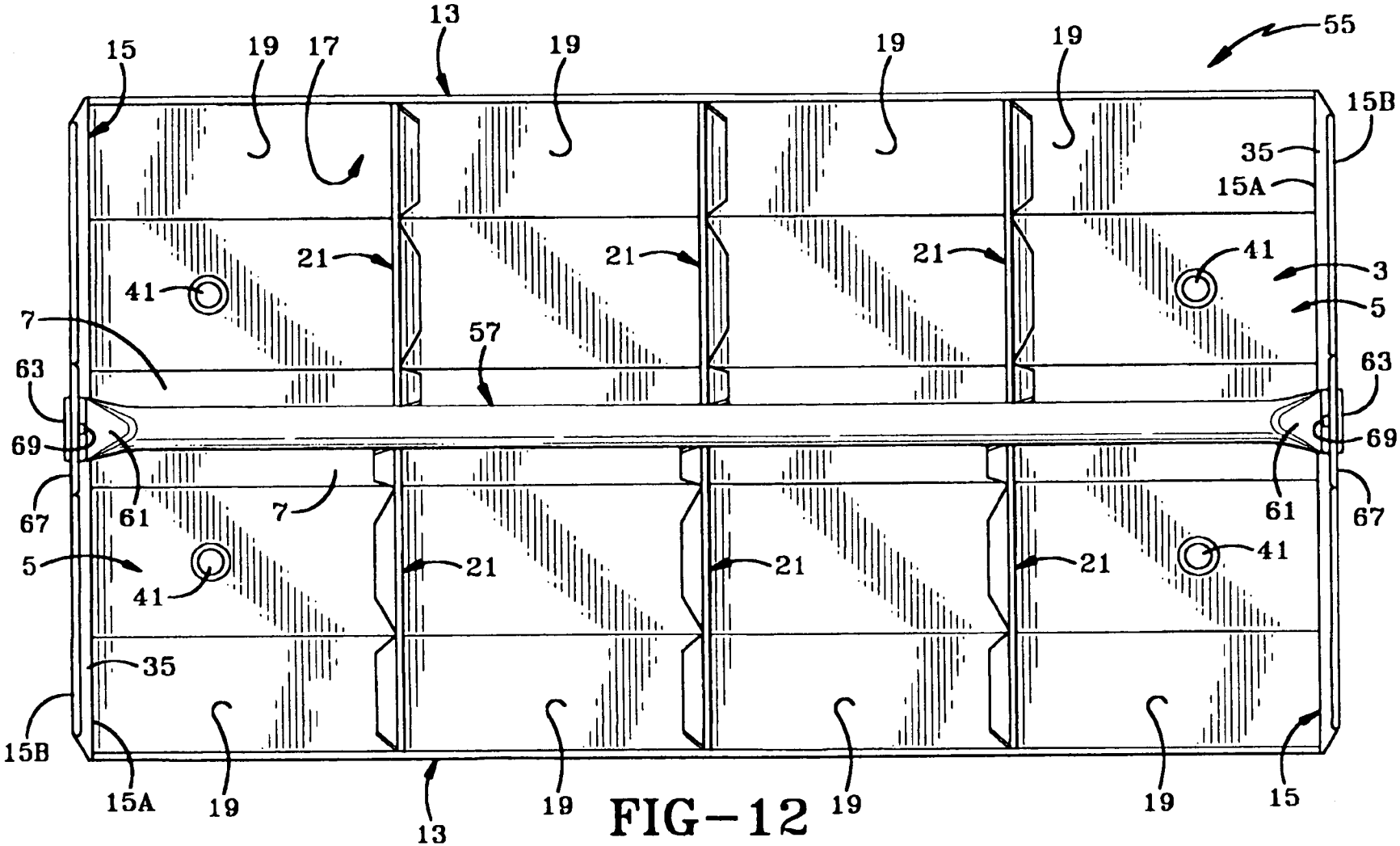
FIG. 12 is a top plan view of a modified stackable storage tray.
Figure 13:
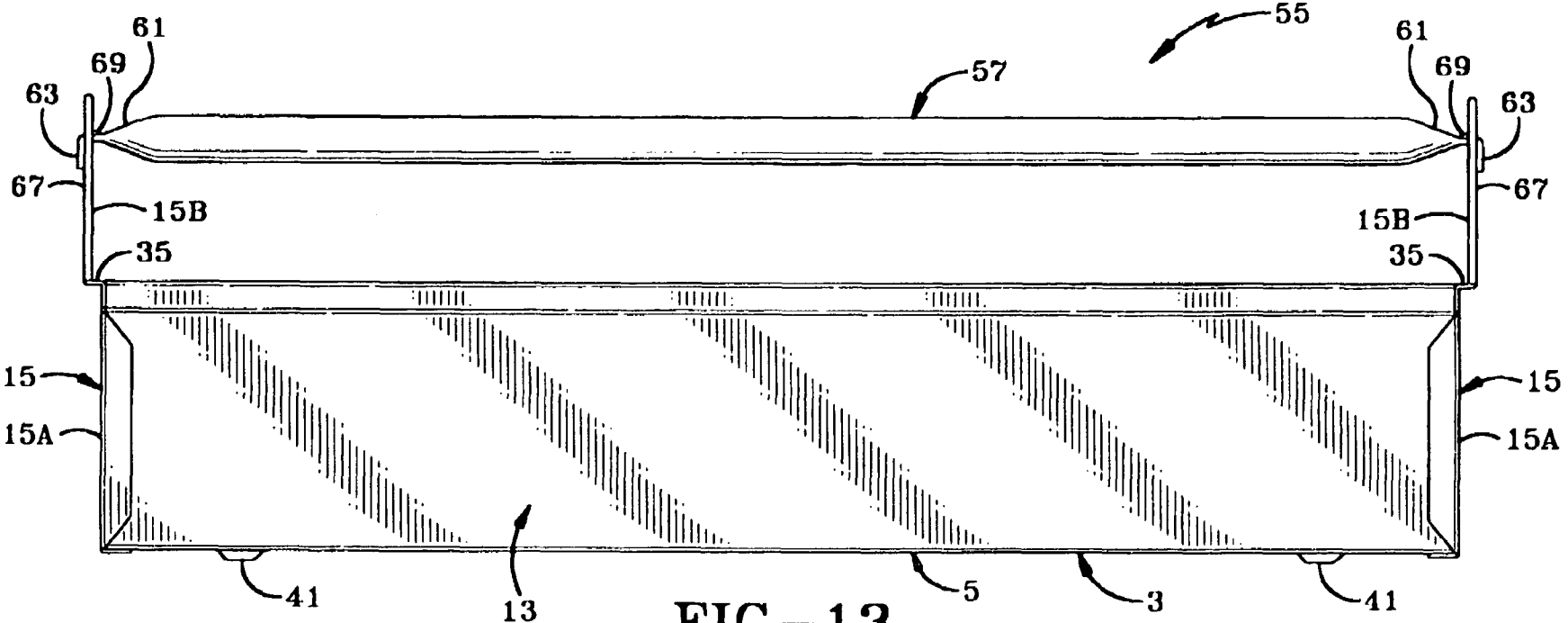
FIG. 13 is a side elevational view of FIG. 12.
Figure 14:
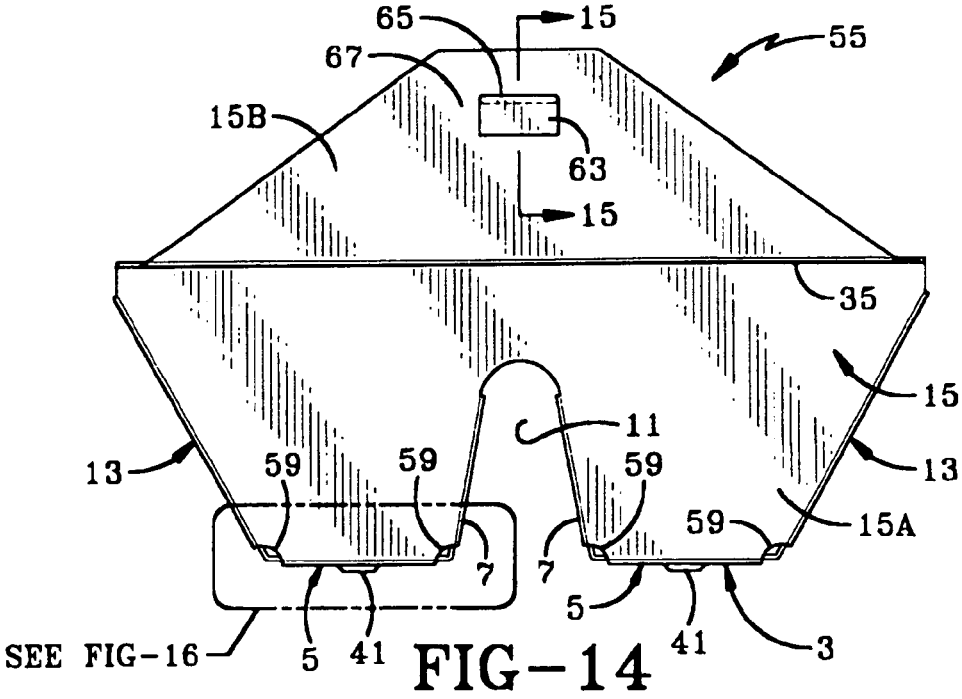
FIG. 14 is a right side end elevational view of FIG. 13.

In accordance with another feature of the invention, a plurality of bosses 41 are formed integrally with bottom wall planar sections 5 and extend outwardly therefrom to provide support feet for supporting the tray on a support surface 43 (FIG. 11). Bosses 41 preferably have a frusto-conical configuration and are provided with a generally flat central portion 45 having a hole 47 formed therein. Hole 47 functions as a liquid drain opening for draining unwanted liquids, such as rain water, from the sub-compartments, and can function as a fastener receiving hole, as shown in FIG. 11, through which a fastener 49 extends for rigidly and securingly mounting tray 1 on support surface 43. Bosses 41 provide a plurality of spaced support surfaces which facilitates the sliding movement of the tray across the support surface when placing and removing the trays therefrom. These plurality of spaced support surfaces reduce sliding friction in contrast to when the entire bottom surface of the tray slides across a supporting surface. In the preferred embodiment, four support bosses 41 are provided, as shown particularly in FIG. 1.

Figure 4:
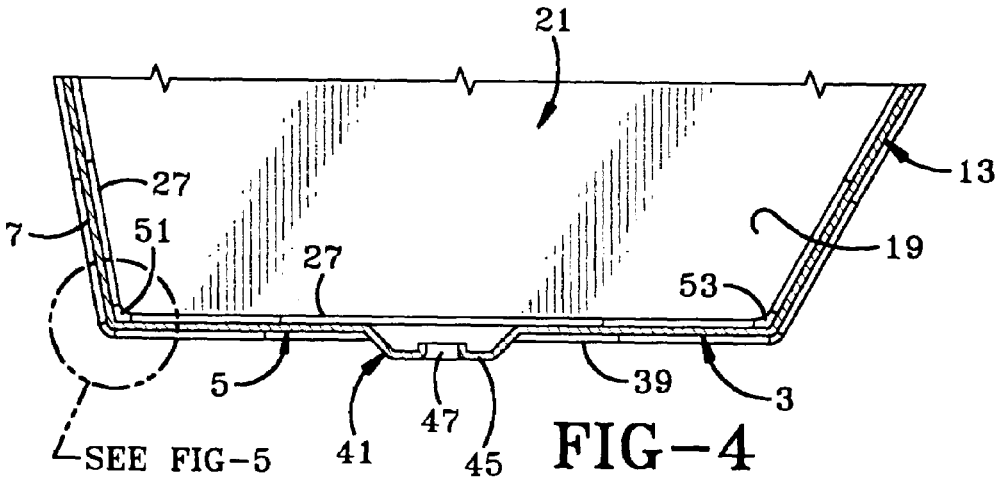
FIG. 4 is an enlarged fragmentary sectional view taken on line 4-4, FIG. 1.

In accordance with another improved feature of the invention, drain openings 51 and 53 are provided at the corners of divider panels 21 and recess forming walls 7 and side walls 13, respectively (FIG. 4), which enable liquid to drain from the various sub-compartments and subsequently through drain holes 47 in bosses 41. Thus, holes 41 and drain openings 51 and 53 prevent the accumulation of liquid, such as from rain water, from collecting and remaining in the sub-storage compartment.

Bottom wall 3, side walls 13, end walls 15, and divider panels 21 are all formed of 24 gage galvanized steel, wherein the prior tray only made the tray body from 24 gage material, with the dividers being formed of 28 gage. However, forming dividers 21 of 24 gage in tray 1 increases the strength and stability of the final tray construction. The preferred type of steel for appearance is CQ-1008 Bright Galvanized G-60 with minimum spangle.

In summary, the improved stackable storage tray of the present invention is formed entirely of 24 gage galvanized steel and is provided with a plurality of supporting feet or bosses, which are formed with holes providing drain openings to the sub-compartments, or openings for receiving fasteners for securing the tray to a support surface. In addition, drain openings are formed between the sub-compartments to permit the free flow of liquid therebetween for subsequent draining through the bottom wall drain holes in the bosses. Likewise, the top edges of the sub-compartment dividing panels, divider edge formed by the bottom wall recess forming walls, side walls, and end wall ledges all lie in a common horizontal plane which insures a plurality of horizontal supporting surfaces for supporting an adjacent tray stacked thereon regardless of the final positioning of the tray.

Figure 5:
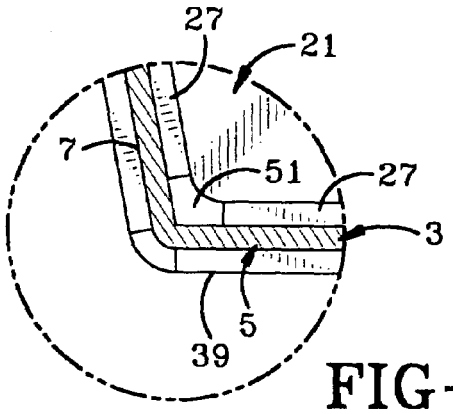
FIG. 5 is an enlarged fragmentary sectional view of the encircled portion of FIG. 4.

A modified embodiment of the stackable storage tray of the present invention is indicated generally at 55, and is shown in FIGS. 12-16. Tray 55 is similar in most respects to tray 1 described above with the main differences being an improved handle indicated generally at 57 and the formation of additional drain holes 59 preferably at the four outside and two inside corners of the tray and formed at the junction of end walls 15, side walls 13 and angled walls 7. These end drain holes 59, together with drain holes 51 and 53 formed in the interior of the storage tray as shown particularly in FIGS. 4 and 5 and discussed above, ensures that any liquid which collects within the main storage compartment 17 will drain easily from the tray preventing the accumulation of liquid and possible damage to the stored contents. Drain holes 47 may also be formed in the bottom of bosses 41 in tray 55, but are not shown in tray 55.

Figure 7:
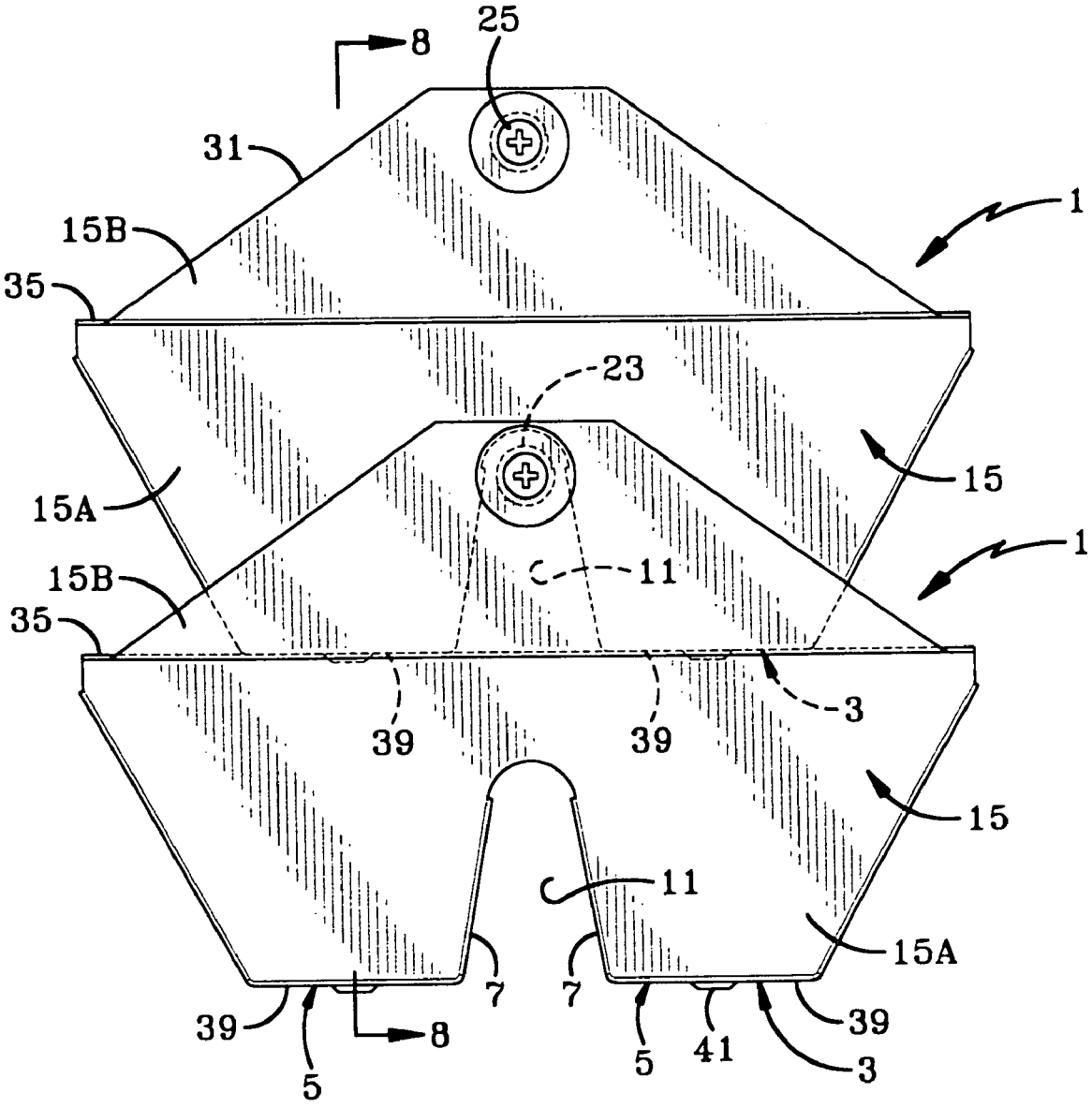
FIG. 7 is an end elevational view of a pair of the storage trays in stacked relationship.
Figure 8:
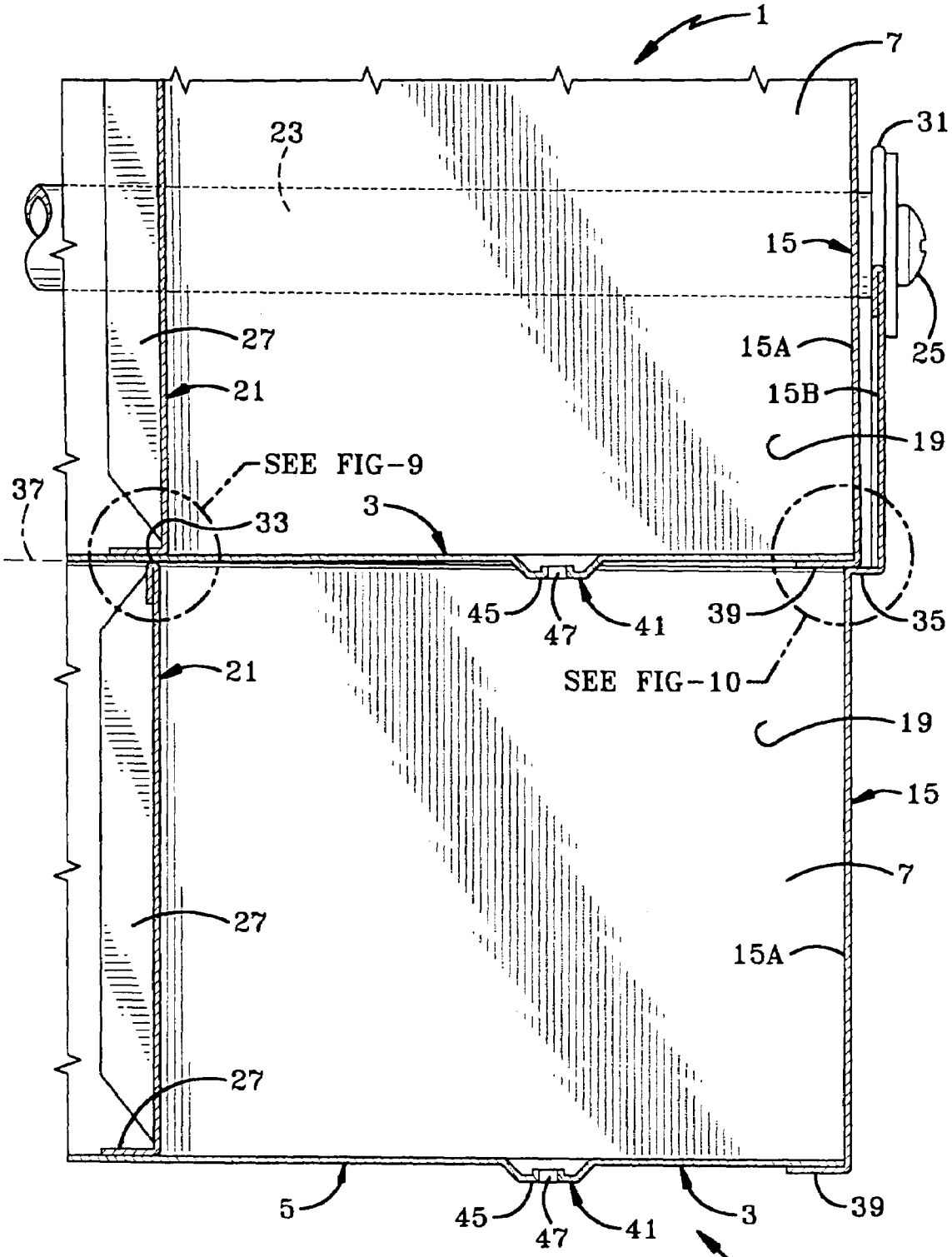
FIG. 8 is an enlarged fragmentary sectional view taken on line 8-8, FIG. 7.
Figure 9:
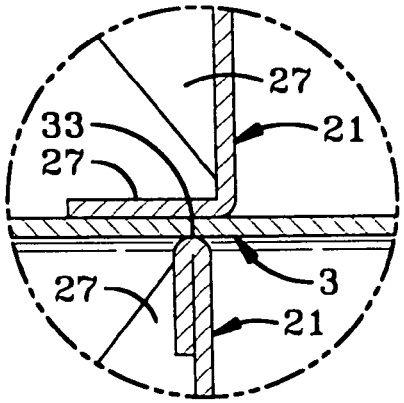
FIG. 9 is an enlarged fragmentary sectional view of the encircled portion of FIG. 8.
Figure 10:
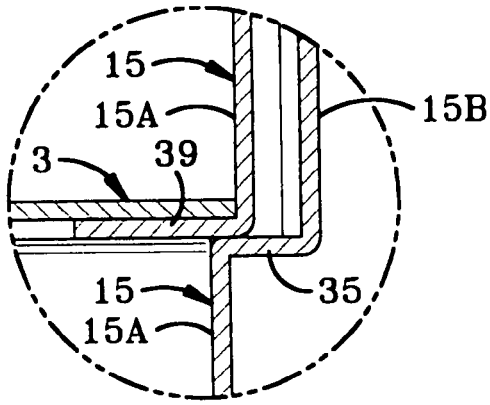
FIG. 10 is an enlarged fragmentary sectional view of the encircled portion of FIG. 8.
Figure 15:
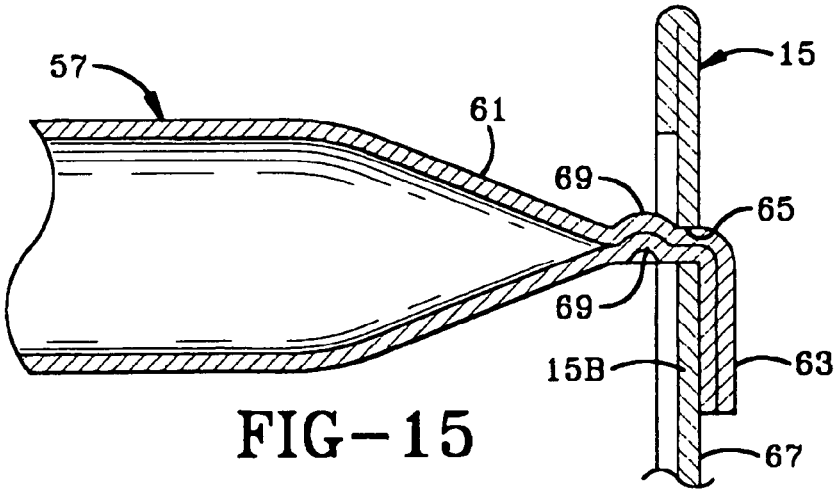
FIG. 15 is an enlarged fragmentary sectional view taken on line 15-15, FIG. 14.
Figure 16:
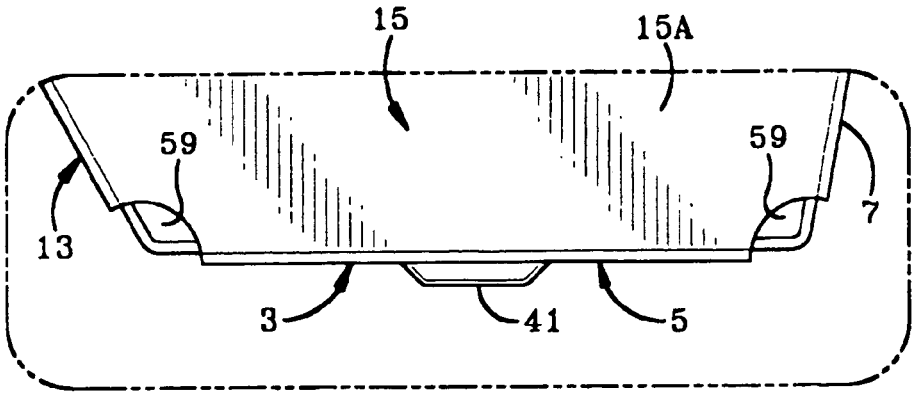
FIG. 16 is an enlarged fragmentary view of the encircled portion of FIG. 14.

In accordance with another of the main features of tray 55 is the unique mounting and attachment of the ends of handle 57 onto the offset upper portion 15B of end wall 15, again spaced above flat planar ledge 35 a distance less than the height of bottom wall recess 11 so that the handle is nestable within the bottom wall recess of an adjacent upper tray when in a stacked relationship as shown in FIGS. 7 and 8. Again, ledge 35 of tray 55 will lie in the common horizontal plane 37 for supporting an adjacent upper tray thereon. Improved handle 57 preferably has a circular cross-sectional configuration as shown in FIG. 15 throughout the majority of its length, and is formed of a hollow tubular member with each distal end 61 being tapered inwardly into a flattened double wall end configuration with a bent end flange 63 extending through a rectangular slot 65 formed in end wall upper portion 15B. End flanges 63 extend downwardly along the outer surfaces 67 of end wall portions 15B and are secured in a tight clamped engagement therewith by a pair of projections 69 formed in the double-walled flattened ends of handle 57 (FIG. 15). Projections 69 which are formed at both distal ends of the handle lock end flanges 63 tightly against outer surfaces 67 and eliminate the need of any additional fasteners or manufacturing operations, such as welding, to rigidly secure the handle in a fixed position between end wall upper portions 15B. This provides for a less expensive handle without sacrificing the rigidity thereof.

Thus, modified tray 55 provides all of the advantages discussed above with respect to tray 1, and in addition provides for end wall drain openings 59, four in each end wall 15 to ensure that any liquid trapped inside of the tray will flow out of the main storage compartment, together with a less expensive and improved handle 57 which is easily formed by a stamping and staking operation by flattening the ends thereof and securing it by projections 69 onto end wall portions 15B by double-walled thickness bent end flanges 63. Handle 57 preferably is formed out of galvanized steel to resist rust and corrosion as is the rest of the storage tray material.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An improved stackable tray having a bottom wall with a pair of bottom wall sections separated by a pair of upwardly extending spaced divider walls terminating in a divider edge and forming a bottom wall recess therebetween, a pair of side walls and a pair of end walls extending upwardly from the bottom wall and forming a storage compartment therebetween, said side walls extending upwardly outwardly angled from said bottom wall, a plurality of divider panels extending between the divider walls and the side walls dividing the storage compartment into a plurality of sub-compartments, and a support handle extending between the end walls and above the side walls for manually transporting the tray, said handle being adapted to be received within the bottom wall recess of an adjacent tray stacked upon said tray; wherein the improvement comprises each of the end walls having a lower portion and an offset upper portion with a generally flat planar ledge formed on each of the end walls between said upper and lower portions and extending inwardly toward each other and lying in a common horizontal plane; the support handle connected to and extending between the upper portions of the end walls and spaced above the flat planar ledge a distance less than the height of the bottom wall recess whereby said handle is nestable within the bottom wall recess of an adjacent upper tray when said tray is in a stacked relationship with said upper tray which is supported on the flat planar ledges of said tray; and said divider panels being secured to at least one of the side walls, divider walls and bottom wall sections by a bent end flange; and drain openings formed between the divider panels and at least one of the bottom wall sections, divider walls and side walls.

2. The improved tray defined in claim 1 including a plurality of bosses formed on and extending outwardly from the bottom wall for supporting the tray on a support surface.

3. The improved tray defined in claim 2 including a hole formed in each of the bosses.

4. The improved tray defined in claim 3 including a fastener extending through the holes in the bosses for attaching the tray to the support surface.

5. The improved tray defined in claim 3 wherein each of the bosses has a generally frustro-conical shape with a central portion; and in which a liquid drain hole is formed in the central portion.

6. The improved tray defined in claim 1 in which the tray is formed of 24 gage galvanized steel.

7. The improved tray defined in claim 6 in which the steel is CQ-1008 Bright Galvanized G-60 with minimum spangle.

8. The improved tray defined in claim 1 including at least one additional drain opening formed in at least one corner formed at the junction of one of the side walls, bottom wall and end walls.

9. The improved tray defined in claim 1 in which an additional drain opening is formed in each corner formed at the junction of the side walls, bottom wall and end walls.

10. The improved tray defined in claim 1 in which the divider edge lies in the common horizontal plane with the end wall flat planar ledges and the divider panels top edges.

11. The improved tray defined in claim 10 in which the side walls terminate in top edges which lie in the same common horizontal plane with the divider edge, end wall flat planar ledges and divider panels top edges.

12. The improved tray defined in claim 1 in which the lower portions of the end walls are formed with U-shaped cutouts which align with and are complementary to the bottom recess formed between the divider walls.

13. The improved tray defined in claim 1 wherein the support handle is an elongated member attached at a pair of opposed ends to the upper portions of the end walls by bent end flanges extending along outer surfaces of said upper portions of the end walls and by projections located adjacent inner surfaces of said upper portions.

14. The improved tray defined in claim 13 wherein the handle is a hollow rod circular in cross section throughout the majority of the length of said handle; and in which the end flanges are formed in flattened end portions of the rod.

15. The improved tray defined in claim 14 wherein the flattened end portions of the rod have a double wall thickness and extend downwardly along the outer surfaces of the offset upper portions of the end walls; and in which the projections are formed in the flattened end portions and engage the inner surfaces of said offset upper portions to clamp the bent end flanges against said outer surfaces of said offset upper end wall portions.

16. The improved tray defined in claim 14 wherein the flattened end wall portions of the handle extend through openings formed in the offset upper end wall portions.

17. A stackable tray having a bottom wall with a pair of bottom wall sections separated by a pair of upwardly extending spaced divider walls terminating in a divider edge and forming a bottom wall recess therebetween, a pair of side walls and a pair of end walls extending upwardly from the bottom wall and forming a storage compartment therebetween, said side walls extending upwardly outwardly angled from said bottom wall, a plurality of divider panels extending between the divider walls and the side walls dividing the storage compartment into a plurality of sub-compartments, and a support handle extending between the end walls and above the side walls for manually transporting the tray, said handle being adapted to be received within the bottom wall recess of an adjacent tray stacked upon said tray; each of the end walls having a lower portion and an offset upper portion with a generally flat planar ledge formed on each of the end walls between said upper and lower portions and extending inwardly toward each other and lying in a common horizontal plane; the support handle connected to and extending between the upper portions of the end walls and spaced above the flat planar ledge a distance less than the height of the bottom wall recess whereby said handle is nestable within the bottom wall recess of an adjacent upper tray when said tray is in a stacked relationship with said upper tray being supported on the flat planar ledges of said tray; and said support handle being an elongated rod attached at a pair of opposed ends to the offset upper portions of the end walls by bent end flanges extending downwardly along outer surfaces of said offset upper portions of the end walls and by projections located adjacent inner surfaces of said offset upper portions which clamp the bent end flanges against the outer surfaces of the offset upper portions of the end walls.

18. The tray defined in claim 17 wherein the handle has a circular cross section throughout the majority of the length of said handle.

19. The tray defined in claim 17 wherein a plurality of drain openings are formed between the divider panels and at least one of the bottom wall sections, divider walls and side walls; and at certain of a plurality of corners formed at ends of the tray at the junctions of the end walls, side walls and bottom wall.

20. The tray defined in claim 17 wherein the opposed ends of the handle are double wall thickness flattened areas; and in which the projections and end flanges are formed in said flattened areas.

* * * * *